United States Patent [19]

Virca et al.

[11] Patent Number: 4,753,358

[45] Date of Patent: Jun. 28, 1988

[54] VIAL CAP COUPLING DEVICE

[75] Inventors: Nicholas J. Virca, Madison; Kenneth Muderlak, Shorewood, both of Wis.

[73] Assignee: Promega Corporation, Madison, Wis.

[21] Appl. No.: 20,919

[22] Filed: Mar. 2, 1987

[51] Int. Cl.[4] ..... B65D 55/16

[52] U.S. Cl. ..... 215/230; 215/306

[58] Field of Search ..... 215/306, 230; 220/375; 222/543

[56] References Cited

U.S. PATENT DOCUMENTS

| | | | |
|---|---|---|---|
| 2,958,439 | 11/1960 | Yochem . | |
| 3,419,179 | 12/1968 | Deuschle . | |
| 3,799,426 | 3/1974 | Pates . | |
| 4,057,168 | 11/1977 | Bosshold | 215/306 X |
| 4,390,111 | 6/1983 | Robbins | 220/375 X |
| 4,526,289 | 7/1985 | Schiemann | 220/375 X |
| 4,534,483 | 8/1985 | Kassis . | |

FOREIGN PATENT DOCUMENTS

| | | | |
|---|---|---|---|
| 1255289 | 1/1961 | France | 220/375 |
| 452896 | 9/1936 | United Kingdom | 222/543 |

*Primary Examiner*—Donald F. Norton

*Attorney, Agent, or Firm*—Isaksen, Lathrop, Esch, Hart & Clark

[57] ABSTRACT

A vial cap coupling device for flexibly coupling together a vial and its sealing cap includes a cylindrical retainer having an inner surface which forms a cavity for snugly receiving the sealing cap and firmly engaging an outer surface of the cap, a slide ring which has an inner diameter which is about the same as the outside diameter of the cylindrical portion of the vial so that the slide ring can be slid up the cylindrical portion of the vial to the rim at the upper end of the cylindrical portion, and a hinge which at its ends is integrally connected to the retainer and slide ring. The vial cap coupling device retainer further includes a small resilient flange which has an upward shelf which retains within the cavity a sealing cap by abutting against a bottom of the cap. A larger flange extends inwardly from a top margin of the retainer inner surface to an inner diameter which is smaller than the diameter of the outer surface of the sealing cap, forming a downward shelf which abuts against a contained sealing cap in the cavity to retain the cap therein. A space for a vial label is formed by the downward shelf, the top of the fully retained sealing cap, and the retainer inner surface. The larger flange defines an opening through which the vial label may be viewed.

22 Claims, 3 Drawing Sheets

VIAL CAP COUPLING DEVICE

BACKGROUND OF THE INVENTION

1. Field of the Invention

The present invention relates to containers and their closures, and more particularly to laboratory vials and containers having tethered caps which seal the vial or container.

2. Description of the Prior Art

Many containers currently exist which may be used as specimen collectors and containers in hospitals and laboratories. Often these devices include two separate pieces, a cap and a vial. When a specimen is to be placed into the container or removed therefrom, the cap is removed and often placed on a surface where it might possibly become contaminated.

Other containers have caps which are each integrally connected to a strap or tether which can be or is connected to the container so that when the cap is removed from the container mouth, the cap remains tethered to the container by the strap. This type of container and tethered cap is disclosed in U.S. Pat. Nos. 2,958,439 to Yochem, No. 3,419,179 to Deuschle et al., and No. 3,799,426 to Pates et al.

It is often desirable to color-code the container caps for product or specimen differentiation. A problem may occur if the specimen or product contained in the vial comes into contact with the color-coded cap and thereby becomes contaminated with the chemicals used for coloring the cap. It is another common practice to label a vial to indicate the product or specimen contained therein. Labels are often applied to the vial using an adhesive or some other means to retain the label on the vial. A problem occurs when the label falls off the vial, thus rendering identification of the specimen or product contained therein more difficult.

SUMMARY OF THE INVENTION

The present invention solves the aforementioned and other problems in the prior art, and provides a vial cap coupling device for flexibly coupling together a vial having a mouth, and the sealing cap. The vial cap coupling device includes a cylindrical retainer having an inner surface which forms a cavity for snugly receiving the sealing cap and engaging an outer surface of the cap, a slide ring which has an inner diameter which is approximately the same as an outside diameter of a cylindrical portion of the vial so that the slide ring can be slid up a cylindrical portion of the vial to a rim at an upper end of the cylindrical portion and so that the slide ring is rotatable about the cylindrical portion, and a hinge strap which at its ends is integrally connected to the retainer and the slide ring. It is preferred that the inner surface of the retainer has a diameter sized such that when the retainer cavity receives a sealing cap which has knurls on its outer surface, the retainer inner surface firmly engages the sealing cap so that when the sealing cap is placed over the mouth of the vial, the sealing cap can be maneuvered onto the vial mouth in sealing relation therewith and the sealing cap can be maneuvered loose from the vial mouth by maneuvering the retainer.

The retainer may further include a small resilient flange which extends inwardly from a lower margin of the retainer inner surface to have an inner diameter which is slightly smaller than the diameter of the outer surface of the sealing cap. This small resilient flange includes a beveled surface formed upwardly and inwardly to allow reception of the sealing cap into the cavity by a user pushing the sealing cap against the beveled surface thereby causing the inside diameter of the small resilient flange to temporarily increase as the cap passes therethrough. The small resilient flange also includes an upward shelf which retains a fully received sealing cap within the cavity by abutting against a bottom of the cap.

The retainer may further include a larger flange which extends inwardly from a top margin of the retainer inner surface to have an inner diameter which is smaller than the diameter of the outer surface of the sealing cap. The larger flange forms a downward shelf which abuts against a fully received sealing cap within the cavity to retain the cap therein. The downward shelf and a top of the fully retained sealing cap and the retainer inner surface together define a space for containing a vial label which may be viewed through an opening defined by the larger flange.

When the present invention is used with a standard laboratory vial and sealing cap, the sealing cap may be removed from the vial without a substantial danger of loss of the cap or contamination of the specimen. The vial cap coupling device may be color-coded and will not come into contact with the products contained in the vial. As a result, there will be little danger of specimen contamination from the chemicals used to color-code the vial. Furthermore, since labels may be placed within the space formed between the downward shelf of the retainer and the sealing cap, there is little chance that these labels will be unintentionally removed.

Further objects, features, and advantages of the invention will be apparent from the following detailed description when taken in conjunction with the accompanying drawings.

DESCRIPTION OF THE PREFERRED EMBODIMENT

Figure 1:
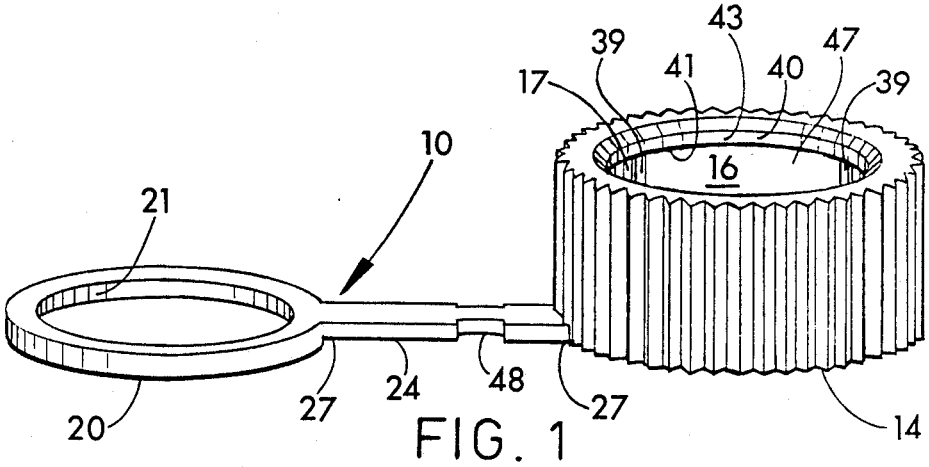
FIG. 1 is a perspective view of a vial cap coupling device constructed in accordance with the invention, and with the retainer connected to the slide ring by way of the interconnected hinge strap.
Figure 2:
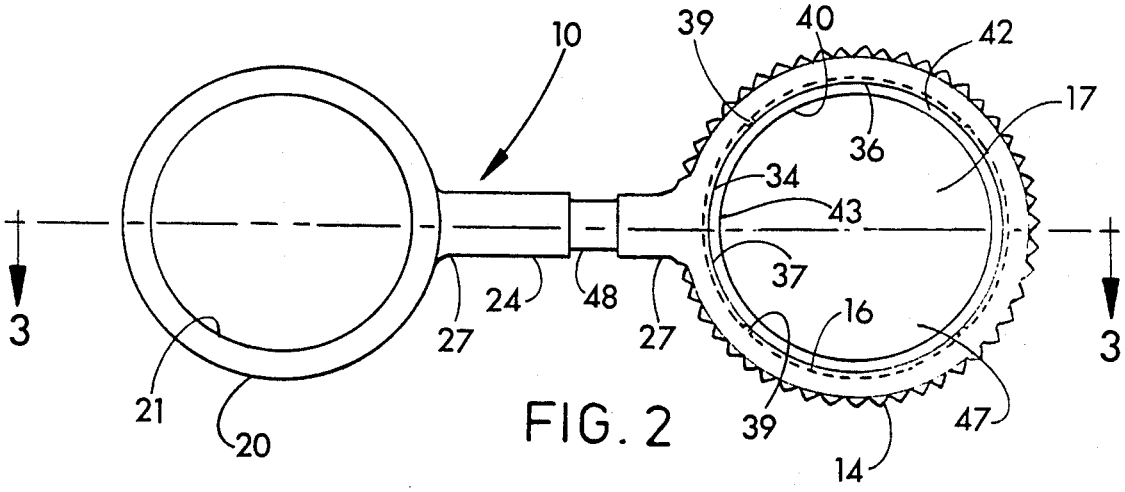
FIG. 2 is a bottom plan view thereof.
Figure 3:
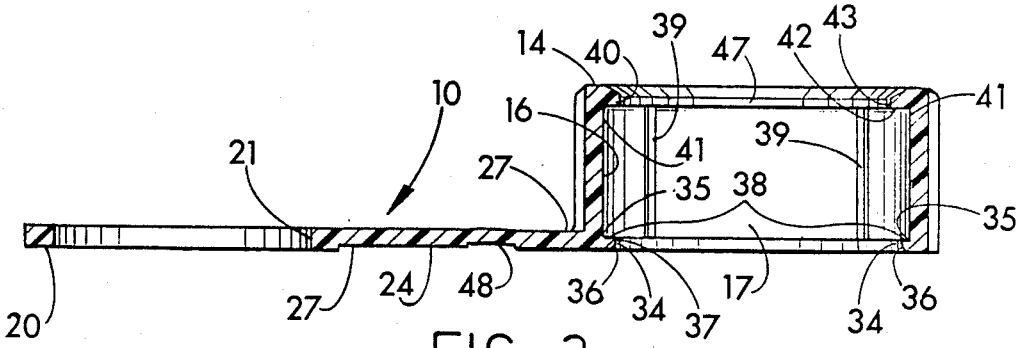
FIG. 3 is a central longitudinal section taken on line 3—3 of FIG. 1.
Figure 4:
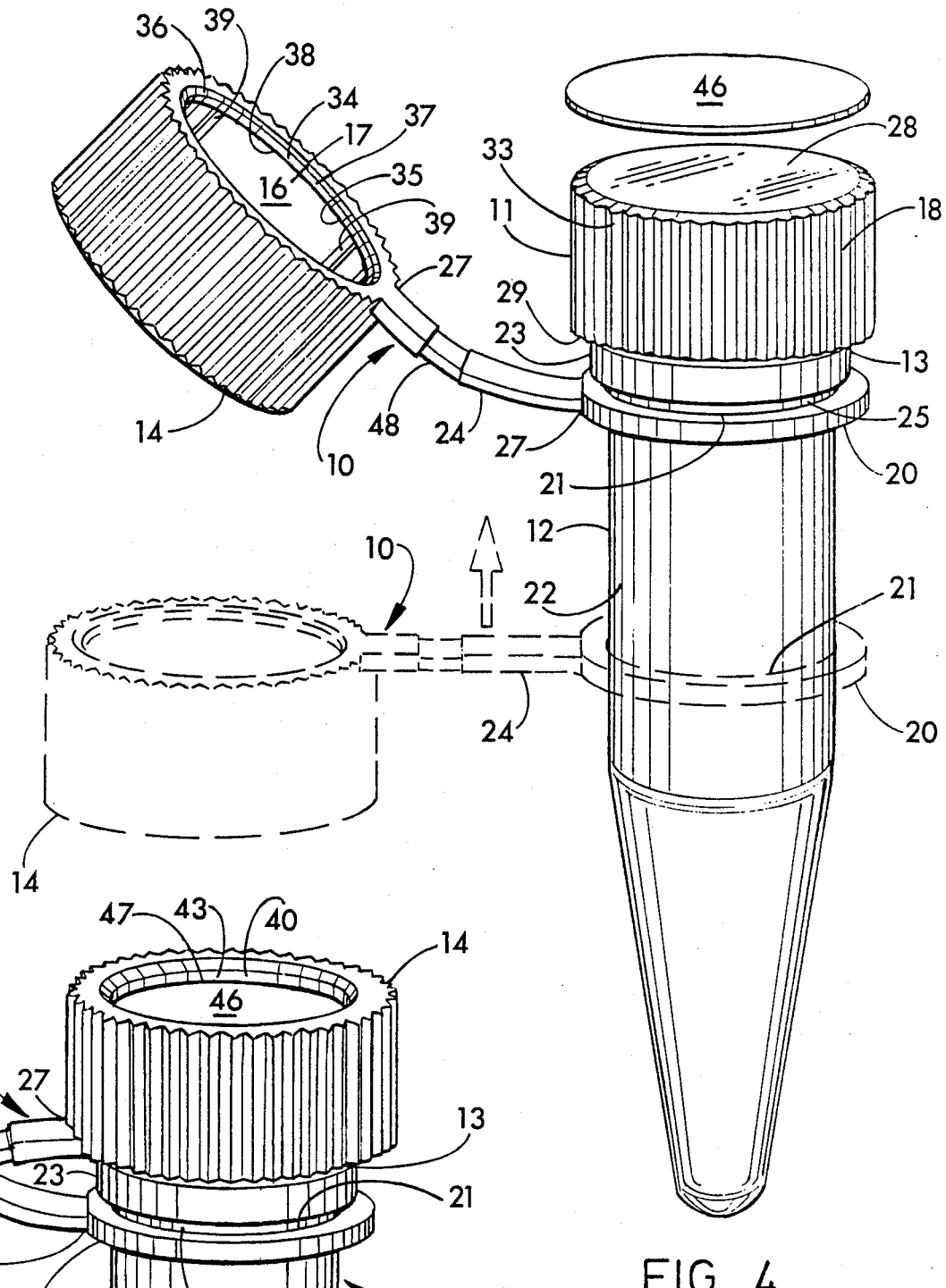
FIG. 4 is a perspective view of a vial with sealing cap screwed thereon in sealing relation, a label projected thereabove and a vial cap coupling device placed on the vial with the slide ring encircling the vial cylindrical portion near the rim and the hinge strap and retainer connected thereto in free relation. A vial cap coupling device which is in position to be slid up the cylindrical portion is shown in dashed lines for illustrative purposes.

As shown in the drawings, the invention is directed to a vial cap coupling device 10 for flexibly coupling a sealing cap 11 to a vial 12 having a mouth 13 over which the sealing cap 11 is placed to close and seal the vial 12. The vial cap coupling device 10 includes a cylindrical retainer 14 having an inner surface 16 which forms a cavity 17 for snugly receiving the sealing cap 11 and for engaging the outer surface 18 of the cap 11. The coupling device 10 furthermore includes a slide ring 20 which has an inner diameter 21 which is approximately equal to the outside diameter of the cylindrical portion 22 of the vial 12 so that the slide ring 20 can be slid up the cylindrical portion 22 of the vial 12 to a rim 23 at the upper end 25 of the cylindrical portion 22 and so that the slide ring 20 can be rotated about the cylindrical portion 22 of the vial 12. The cylindrical retainer 14 and the slide ring 20 are hingedly interconnected by an integrally formed hinge strap 24 at the ends 27 thereof as shown in FIGS. 1–3. The vial cap coupling device 10 is designed to be used in combination with a conventional laboratory vial 12 which is used for containing specimens, or biological products such as restriction enzymes and modifying enzymes. As shown in FIGS. 4–7, a standard screw cap vial 12 includes a cylindrical portion 14, a rim 23 which extends outwardly from an upper end 25 of the cylindrical portion 22 of the vial 12, and a mouth 13 which has threads 26 onto which the sealing cap 11 is screwed. The sealing cap 11 includes a top 28, a bottom 29, an outer surface lS, an O-ring 30, and an insert portion 31 which fits into the vial 12 when the cap 11 is closed over the vial 12. As shown in FIG. 4, the standard sealing cap 11 has an outer surface 18 with ridged knurls 33.

Figure 5:
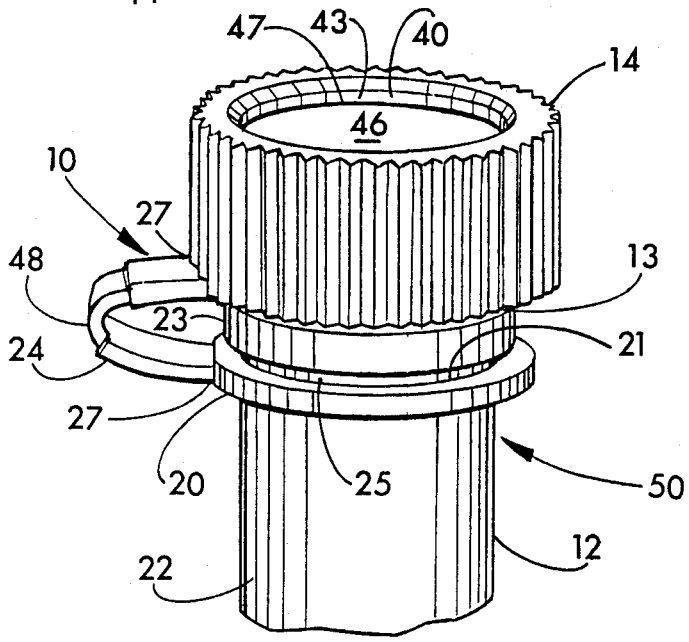
FIG. 5 is a perspective view of the coupled vial whereby the retainer is placed over the sealing cap of the vial to engage the sealing cap.
Figures 6, 7:
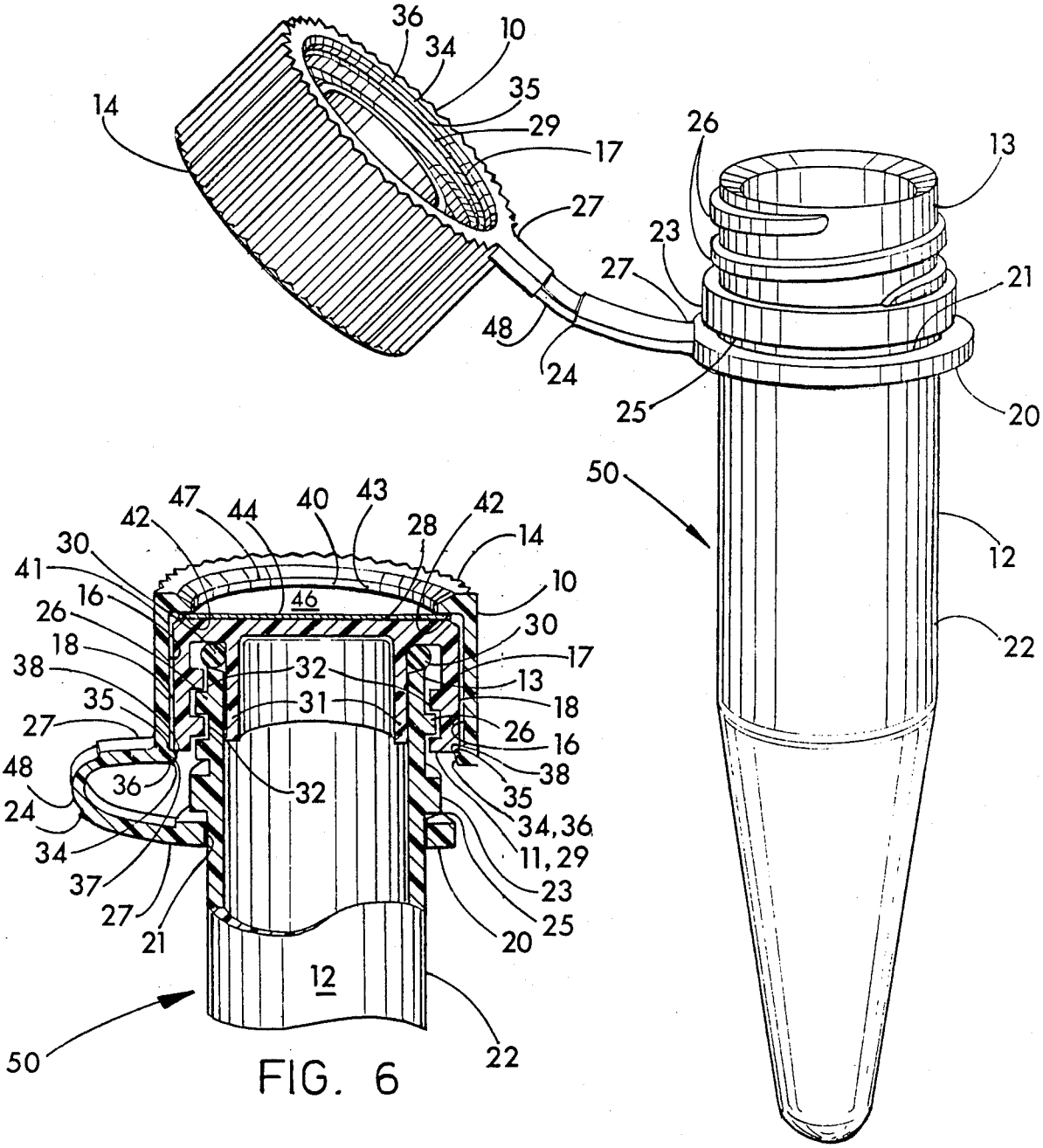
FIG. 6 is a section view taken on line 6—6 of FIG. 5.
FIG. 7 is a perspective view of the coupled vial of FIG. 5 with the retainer and sealing cap contained therein removed from the mouth of the vial.

The inner diameter 21 of the sliding ring 20 shown in FIGS. 1–3 should be about the same as the outside diameter of the cylindrical portion 22 so that the slide ring 20 can be slid up the cylindrical portion 22 and placed near the rim 23 of the vial 12. The slide ring 20 should be able to be rotated concentrically about the cylindrical portion 22 of the vial 12. It is also preferred that the slide ring 20 fit snugly around the cylindrical portion 22 so that it does not have a tendency to fall down the cylindrical portion 22. The inner surface 16 of the retainer 14 should have a sufficiently small diameter such that when the retainer cavity 17 receives the sealing cap 11, which has knurls 33 on its outer surface 18 and which has threads 32 for screwing the cap 11 onto the vial mouth 13, the retainer inner surface 16 firmly engages the sealing cap 11. Thus, when the sealing cap 11 is placed over the threaded mouth 13 of the vial 12, rotation of the retainer 14 in one direction also rotates the sealing cap 11 onto the vial threaded mouth 13 to close and seal the vial 12, and rotation of the retainer 14 in an opposite direction causes the sealing cap 11 to be loosed from the threaded mouth 13. The retainer 14 and sealing cap 11 turn together and thus act as a single unit, so that the sealing cap 11 is effectively "unitarily" engaged by the retainer 14. The retainer inner surface 16 also has four axial ridges 39 which mesh with the knurls 33 on the sealing cap 11 to further assure that the retainer 14 and sealing cap 11 turn together and act as a single unit. The retainer 14 preferably includes a small resilient flange 34 which extends inwardly from a lower margin 35 of the retainer inner surface 16 to have an inside diameter 37 which is slightly smaller than the diameter of the outer surface 18 of the sealing cap 11. The small resilient flange 34 preferably includes a beveled surface 36 which is formed upwardly and inwardly to allow reception of the sealing cap 11 into the cavity 17 by the user pushing the sealing cap 11 against the beveled surface 36 to thereby cause the inside diameter 37 of the small resilient flange 34 to temporarily increase as the cap 11 passes therethrough. The small resilient flange 34 furthermore preferably includes an upward shelf 38 which retains the fully received sealing cap 11 within the cavity 17 by abutting against the bottom 29 of the cap 11 as shown in FIG. 6. The retainer 14 preferably also includes a larger flange 40 which extends inwardly from the top margin 41 of the retainer inner surface 16 so as to have an inner diameter 43 which is smaller than the diameter of the outer surface 18 of the cap 11. This larger flange 40 forms a downward shelf 42 which abuts against the top 28 of a fully received sealing cap 11 to thereby retain the cap 11 within the cavity 17. The downward shelf 42 and the top 28 of a fully retained sealing cap 11 and the retainer inner surface 16 preferably define a space 44 for containing a vial label 46. The larger flange 40 defines an opening 47 through which the vial label 46 may be viewed as shown in FIG. 5.

The hinge strap 24 of the preferred vial cap coupling device 10 must be of sufficient length to allow the vial sealing cap 11 contained in the retainer 14 to be placed on and taken off of the mouth 13 of the vial 12 when the slide ring 20 is located encircling the cylindrical portion 22 of the vial 12 near the vial rim 23. Accordingly, the hinge strap 24 must be of sufficient length to allow a user to open the vial 12 and to close and seal the vial 12 while the slide ring is in proper position about the cylindrical portion 22 of the vial 12, and the sealing cap 11 is contained within the retainer 14. The hinge strap 24 preferably includes a narrowed neck 48 which causes the strap 24 to be more flexible than it would be without the neck 48.

In its use, the vial cap coupling device 10 of FIGS. 1–3 is intended to be a device which tethers the standard sealing cap 11 to the vial 12, so that when the cap 11 is removed from the vial 12, the cap 11 will not be lost or placed on a surface which could contaminate the cap 11. The user may take the vial cap coupling device 10 by its slide ring and place it on the cylindrical portion 22, slipping it up to the rim 23 of the vial 12 with the beveled surface 36 of the small resilient flange 34 facing upwardly as shown in dashed lines in FIG. 4. Once the slide ring 20 is located near the rim 23, the hinge strap 24 should allow the user to grasp the retainer and snap it over the sealing cap 11 so that the sealing cap 11 is fully contained within the retainer cavity 17 as shown in FIGS. 5–7. As the retainer 14 is pushed over the sealing cap 11, the sealing cap 11 passes through the small resilient flange 34 expanding its inside diameter 37 until the cap 11 passes entirely through the flange 34. Once the cap 11 is fully contained within the cavity 17 of the retainer 14, the inside diameter 37 of the resilient flange 34 snaps back to its normal size so that the upward shelf 38 retains the cap 11 within the cavity 17. The user may then remove the sealing cap 11 from the vial 12 by grasping the retainer 14 and rotating it in the proper direction to remove the cap 11. After the cap 11 is removed from the vial 12, the cap 11 will remain within the retainer cavity 17 as shown in FIG. 7. The user may again seal the vial by grasping the retainer 14, placing it with the seal cap 11 in appropriate position over the mouth 13 of the vial 12, and rotating the retainer 14 in an opposite direction to turn the cap 11 onto the threads 26 on the mouth 13 of the vial 12.

Although the vial cap coupling device 10 shown in the drawings is used in combination with a sealing cap 11 having threads 32 which engage other threads 26 on the mouth 13 of the vial 12 to thereby seal the cap 11 onto the vial 12, the device 10 of the present invention could also be used in combination with a sealing cap which seals the vial in another manner, such as by a resilient snapping engagement of a lip on the mouth of a vial, or by some form of friction engagement between the sealing cap and vial. In such a case, the retainer 14 should still unitarily engage the sealing cap so that the cap can be maneuvered into sealing relation with the mouth of the vial, or maneuvered loose therefrom by maneuvering the retainer.

A coupled vial 50 according to the present invention such as is shown in FIGS. 5–7, includes a sealing cap 11 with a top 28 and an outer surface 18, a vial 12 having a mouth 13, a cylindrical portion 22 and a rim 23 at an upper end 25 of the cylindrical portion 22 of the vial 12. The coupled vial 50 furthermore includes a cylindrical retainer 14 having an inner surface 16 which forms a cavity 17 for snugly containing and holding the sealing cap 11 and engaging the outer surface 18 of the cap 11, a slide ring 20 which slidably fits around the cylindrical portion 22 of the vial 12 near the rim 23, and a hinge strap 24 which at its ends 27 is integrally interconnected to the retainer 14 and the slide ring 20. The coupled vial 50 furthermore has a space 44 for containing a vial label 46. This space 44 is defined by the downward shelf 42, the top 28 of the sealing cap 11, and the retainer inner surface 16. The preferred coupled vial 50 therefore furthermore includes a vial label 46 which is contained in the space 44 therefor. The larger flange 40 defines an opening 47 through which the vial label 46 held in the space 44 may be viewed by a user.

The vial cap coupling device 10 may be color-coded to indicate the particular product or specimen which is contained within the vial 12. Since the vial cap coupling device 10 is not a part of the sealing cap 11 which comes into contact with the specimen or product, the chemicals used for color-coding the coupling device 10 will not contaminate the specimen or product contained within the vial 12. Vial labels 46 which are contained in the space 44 will be held therein by the downward shelf 42, and therefore will not have any tendency to fall off the sealing cap top 28. Since the slide ring 20 slidably encircles the cylindrical portion of the vial 12, the slide ring 20 will rotate about the cylindrical portion 22 thereby allowing the retainer 14 and the contained sealing cap 11 to be unscrewed or screwed back onto the vial 12. Furthermore, when a user removes the sealing cap 11 from the mouth 13 of the vial 12, the sealing cap 11 will remain tethered to the vial 12 by means of the vial cap coupling device 10 so that the cap 11 will not be lost or placed on a surface which could contaminate the cap 11.

It is understood that the invention is not confined to the particular construction and arrangement herein illustrated and described, but embraces such modified forms thereof as come within the scope of the following claims.

What is claimed is:

1. A vial cap coupling device for flexibly coupling together a vial having a mouth and its sealing cap, comprising:

(a) a cylindrical retainer having an inner surface which forms a cavity for snugly receiving the sealing cap and engaging an outer surface of the cap;

wherein the retainer further includes a larger flange which extends inwardly from a top margin of the retainer inner surface to have an inner diameter which is smaller than the diameter of the outer surface of the sealing cap, forming a downward shelf which abuts against a fully received sealing cap in the cavity to retain the cap therein;

(b) a slide ring which has an inner diameter which is approximately the same as an outside diameter of a cylindrical portion of the vial so that the slide ring can be slid up to a rim at an upper end of the cylindrical portion and so that the slide ring is rotatable about the cylindrical portion; and (c) a hinge strap which at its ends is integrally connected to the retainer and the slide ring.

2. The vial cap coupling device of claim 1 wherein the inner diameter of the slide ring is sized closely to the outside diameter of the vial cylindrical portion so that the slide ring can fit snugly enough about the cylindrical portion so that it does not tend to fall down the cylindrical portion.

3. The vial cap coupling device of claim 1 wherein the inner surface of the retainer has a diameter sized such that when the retainer cavity receives a sealing cap which has knurls on its outer surface, the retainer inner surface firmly engages the sealing cap so that the retainer and sealing cap turn as a unit, whereby when the sealing cap is placed over the mouth of the vial, the sealing cap can be maneuvered onto the vial mouth in sealing relation therewith by maneuvering the retainer, and the cap can be maneuvered loose from the mouth by maneuvering the retainer.

4. The vial cap coupling device of claim 3 wherein the inner surface of the retainer has a diameter sized such that when the retainer cavity receives a sealing cap which has threads for screwing the cap onto a vial mouth which also is threaded, the retainer inner surface engages the sealing cap so that when the sealing cap is placed over the threaded mouth of the vial, rotating the retainer in one direction rotates the sealing cap onto the vial threaded mouth to close and seal the vial, and rotating the retainer in an opposite direction causes the sealing cap to be loosed from the threaded mouth.

5. The vial cap coupling device of claim 1 wherein the downward shelf and a top of a fully retained sealing cap and the retainer inner surface define a space for containing a vial label; and wherein the larger flange defines an opening through which a vial label may be viewed.

6. The vial cap coupling device of claim 1 wherein the hinge strap includes a narrowed neck which allows for a greater flexibility in the hinge strap.

7. The vial cap coupling device of claim 1 wherein the hinge strap is of sufficient length to allow the vial sealing cap contained in the retainer to be placed on and taken off the mouth of the vial thereby sealing and opening the vial when the slide ring is located encircling the cylindrical portion of the vial adjacent the rim.

8. A vial cap coupling device for flexibly coupling together a vial having a mouth and its sealing cap, comprising:

(a) a cylindrical retainer having an inner surface which forms a cavity for snugly receiving the sealing cap and engaging an outer surface of the cap;

(b) a slide ring which has an inner diameter which is approximately the same as an outside diameter of a cylindrical portion of the vial so that the slide ring can be slid up to a rim at an upper end of the cylindrical portion and so that the slide ring is rotatable about the cylindrical portion; and (c) a hinge strap which at its ends is integrally connected to the retainer and the slide ring;

wherein the inner surface of the retainer has a diameter sized such that when the retainer cavity receives a sealing cap which has knurls on its outer surface, the retainer inner surface firmly engages the sealing cap so that the retainer and sealing cap turn as a unit, whereby when the sealing cap is placed over the mouth of the vial, the sealing cap can be maneuvered onto the vial mouth in sealing relation therewith by maneuvering the retainer, and the cap can be maneuvered loose from the mouth by maneuvering the retainer;

wherein the inner surface of the retainer includes at least one axial ridge for meshing with the knurls on the outer surface of a sealing cap.

9. A vial cap coupling device for flexibly coupling together a vial having a mouth and its sealing cap, comprising:

(a) a cylindrical retainer having an inner surface which forms a cavity for snugly receiving the sealing cap and engaging an outer surface of the cap;

(b) a slide ring which has an inner diameter which is approximately the same as an outside diameter of a cylindrical portion of the vial so that the slide ring can be slid up to a rim at an upper end of the cylindrical portion and so that the slide ring is rotatable about the cylindrical portion; and (c) a hinge strap which at its ends is integrally connected to the retainer and the slide ring;

wherein the retainer further includes a small resilient flange which extends inwardly from a lower margin of the retainer inner surface to have an inside diameter which is slightly smaller than the diameter of the outer surface of the sealing cap, the small resilient flange including a beveled surface formed upwardly and inwardly to allow reception of the sealing cap into the cavity by a user pushing the sealing cap upwardly against the beveled surface causing the inside diameter of the small resilient flange to temporarily increase as the cap passes therethrough, and an upward shelf which retains a fully received sealing cap within the cavity by abutting against a bottom of the cap.

10. A coupled vial comprising:

(a) a sealing cap including a top and an outer surface of selected diameter;

(b) a vial having a mouth and including a cylindrical portion and a rim at an upper end of the cylindrical portion;

(c) a cylindrical retainer having an inner surface which forms a cavity which snugly contains and holds the sealing cap with the inner surface of the retainer engaging the outer surface of the cap, the inner surface of the retainer having a diameter substantially equal to the outside diameter of the outer surface of the cap so that the retainer inner surface diameter is sized to firmly engage the contained seal cap so that the retainer and cap fit tightly together to turn as a unit, whereby when the sealing cap is placed over the mouth of the vial, the sealing cap can be maneuvered onto the vial mouth in sealing relation therewith by maneuvering the retainer and the cap can be maneuvered loose from the mouth by maneuvering the container;

(d) a slide ring having an inner diameter which is about the same as an outside diameter of the cylindrical portion, the slide ring slidably fitting around the cylindrical portion of the vial near the rim so that the slide ring is rotatable about the cylindrical portion; and (e) a hinge strap which at its ends is integrally connected to the retainer and the slide ring.

11. The coupled vial of claim 10 wherein the inner diameter of the slide ring is sized closely to the outside diameter of the cylindrical portion of the vial so that the slide ring fits snugly enough about the cylindrical portion so that it does not tend to fall when the retainer and contained sealing cap are removed from the mouth of the vial.

12. The coupled vial of claim 10 wherein the hinge strap includes a narrowed neck which allows for a greater flexibility in the hinge strap.

13. The coupled vial of claim 10 wherein the hinge strap is of sufficient length to allow the vial sealing cap contained in the retainer to be placed on and taken off the mouth of the vial thereby sealing and opening the vial when the slide ring is located encircling the cylindrical portion of the vial adjacent the rim.

14. A coupled vial comprising:

(a) a sealing cap including a top and an outer surface;

(b) a vial having a mouth and including a cylindrical portion and a rim at an upper end of the cylindrical portion;

(c) a cylindrical retainer having an inner surface which forms a cavity which snugly contains and holds the sealing cap with the inner surface of the retainer engaging the outer surface of the cap;

(d) a slide ring having an inner diameter which is about the same as an outside diameter of the cylindrical portion, the slide ring slidably fitting around the cylindrical portion of the vial near the rim so that the slide ring is rotatable about the cylindrical portion; and (e) a hinge strap which at its ends is integrally connected to the retainer and the slide ring;

wherein the outer surface of the sealing cap has knurls and the inner surface of the retainer has a diameter sized to firmly engage the container sealing cap so that the retainer and sealing cap turn as a unit, whereby when the sealing cap is placed over the mouth of the vial, the sealing cap can be maneuvered onto the vial mouth in sealing relation therewith by maneuvering the retainer and the cap can be maneuvered loose from the mouth by maneuvering the retainer.

15. The coupled vial of claim 14 wherein the inner surface of the retainer includes at least one axial ridge which meshes the knurls on the outer surface of the sealing cap.

16. The coupled vial of claim 14 wherein the mouth of the vial and the sealing cap each have threads so that the cap can be screwed onto the threaded mouth; and wherein the inner surface of the retainer has a diameter sized such that the retainer inner surface engages the sealing cap outer surface so that when the sealing cap is placed over the threaded mouth of the vial, rotating the retainer in one direction rotates the sealing cap onto the vial threaded mouth to close and seal the vial, and rotating the retainer in an opposite direction causes the sealing cap to be loosed from the threaded mouth.

17. A coupled vial comprising:

(a) a sealing cap including a top and an outer surface;

(b) a vial having a mouth and including a cylindrical portion and a rim at an upper end of the cylindrical portion;

(c) a cylindrical retainer having an inner surface which forms a cavity which snugly contains and holds the sealing cap with the inner surface of the retainer engaging the outer surface of the cap;

(d) a slide ring having an inner diameter which is about the same as an outside diameter of the cylindrical portion, the slide ring slidably fitting around the cylindrical portion of the vial near the rim so that the slide ring is rotatable about the cylindrical portion; and (e) a hinge strap which at its ends is integrally connected to the retainer and the slide ring;

wherein the retainer further includes a small resilient flange which extend inwardly from a lower margin of the retainer inner surface to have an inside diameter which is slightly smaller than the diameter of the outer surface of the sealing cap, the small resilient flange including a beveled surface formed upwardly and inwardly to have allowed reception of the sealing cap into the cavity by a user pushing the sealing cap upwardy against the beveled surface causing the inside diameter of the small resilient flange to temporarily increase as the cap was pushed therethrough into the cavity, and an upper shelf which retains the contained sealing cap within the cavity by abutting against a bottom of the cap.

18. A coupled vial comprising:

(a) a sealing cap including a top and an outer surface;

(b) a vial having a mouth and including a cylindrical portion and a rim at an upper end of the cylindrical portion;

(c) a cylindrical retainer having an inner surface which forms a cavity which snugly contains and holds the sealing cap with the inner surface of the retainer engaging the outer surface of the cap;

(d) a slide ring having an inner diameter which is about the same as an outside diameter of the cylindrical portion, the slide ring slidably fitting around the cylindrical portion of the vial near the rim so that the slide ring is rotatable about the cylindrical portion; and (e) a hinge strap whic at its ends is integrally connected to the retainer and the slide ring;

wherein the retainer further includes a larger flange which extends inwardly from a top margin of the retainer inner surface to have an inner diameter which is smaller than the diameter of the outer surface of the sealing cap the flange including a downward shelf which abuts against the contained sealing cap to retain the cap within the cavity.

19. The coupled vial of claim 18 wherein the downward shelf, a top of the contained sealing cap and the retainer inner surface define a space for containing a vial label; and wherein the larger flange defines an opening through which a vial label held in the space may be viewed.

20. The coupled vial of claim 19 further including a vial label held within the space therefor.

21. A vial cap coupling device for flexibly coupling together a vial having a mouth and its sealing cap, comprising:

a cylindrical retainer having an inner surface which forms a cavity for snugly receiving the sealing cap and engaging an outer surface of the cap;

(b) a slide ring which has an inner diameter which is approximately the same as an outside diameter of a cylindrical portion of the vial so that the slide ring can be slid up to a rim at an upper end of the cylindrical portion and so that the slide ring is rotatable about the cylindrical portion; and (c) a hinge strap which at its ends is integrally connected to the retainer and the slide ring;

wherein the retainer further includes a small resilient flange which extends inwardly from a lower margin of the retainer inner surface to have an inside diameter which is slightly smaller than the diameter of the outer surface of the sealing cap, the small resilient flange including a upward shelf which retains a fully received sealing cap within the cavity by abutting against a bottom of the cap.

22. A coupled vial comprising:

(a) a sealing cap including a top and an outer surface;

(b) a vial having a mouth and including a cylindrical portion and rim at an upper end of the cylindrical portion;

(c) a cylindrical retainer having an inner surface which forms a cavity which snugly contains and holds the sealing cap with the inner surface of the retainer engaging the outer surface of the cap;

(d) a slide ring having an inner diameter which is about the same as an outside diameter of the cylindrical portion, the slide ring slidably fitting around the cylindrical portion of the vial near the rim so that the slide ring is rotatable about the cylindrical portion; and (e) a hinge strap which at its ends is integrally connected to the retainer and the slide ring;

wherein the retainer further includes a small resilient flange which extends inwardly from a lower margin of the retainer inner surface to have an inside diameter which is slightly smaller than the diameter of the outer surface of the sealing cap, the small resilient flange including an upper shelf which retains the contained sealing cap within the cavity by abutting against a bottom of the cap.

* * * * *